US005871337A

United States Patent [19]

Fukanuma et al.

[11] Patent Number: 5,871,337

[45] Date of Patent: Feb. 16, 1999

[54] SWASH-PLATE COMPRESSOR WITH LEAKAGE PASSAGES THROUGH THE DISCHARGE VALVES OF THE CYLINDERS

[75] Inventors: Tetsuhiko Fukanuma; Masahiro Kawaguchi; Ken Suitou; Tomohiko Yokono, all of Kariya, Japan

[73] Assignee: Kabushiki Kaisha Toyoda Jidoshokki Seisakusho, Kariya, Japan

[21] Appl. No.: 735,671

[22] Filed: Oct. 23, 1996

[30] Foreign Application Priority Data

Oct. 26, 1995 [JP] Japan ..... 7-279338

[51] Int. Cl.[6] ..... F04B 1/79

[52] U.S. Cl. ..... 417/222.2; 417/295; 417/571; 417/269

[58] Field of Search ..... 417/222.2, 295, 417/571, 269

[56] References Cited

U.S. PATENT DOCUMENTS

| | | | |
|---|---|---|---|
| 5,078,582 | 1/1992 | Ohbayashi et al. | 417/571 |
| 5,112,198 | 5/1992 | Skinner | 417/269 |
| 5,173,032 | 12/1992 | Taguchi et al. | 417/222.2 |
| 5,181,834 | 1/1993 | Ikeda et al. | 417/269 |
| 5,584,670 | 12/1996 | Kawaguchi et al. | 417/222.2 |
| 5,636,973 | 6/1997 | Sonobe et al. | 417/222.2 |
| 5,647,266 | 7/1997 | Claas | 92/71 |
| 5,681,150 | 10/1997 | Kawaguchi et al. | 417/222.2 |
| 5,713,725 | 2/1998 | Kawaguchi et al. | 417/222.2 |

FOREIGN PATENT DOCUMENTS

| | | |
|---|---|---|
| 3244003 | 5/1984 | Germany . |
| 3735802 | 5/1988 | Germany . |
| 4110647 | 10/1991 | Germany . |
| 4439512 | 5/1995 | Germany . |
| 4446087 | 6/1995 | Germany . |

*Primary Examiner*—Timothy Thorpe
*Assistant Examiner*—Ehud Gartenberg
*Attorney, Agent, or Firm*—Morgan & Finnegan, LLP

[57] ABSTRACT

A compressor has a swash (slanting-cam) plate located in a crank chamber and mounted on a drive shaft. The cam plate is tiltable between a maximum inclined angle position and a minimum inclined angle position with respect to a plane perpendicular to an axis of a drive shaft according to a difference between the pressures in the crank chamber and a cylinder bore. The cam plate varies the stroke of a piston in the cylinder bore based on an inclination thereof to control the displacement of the compressor. A shutter member is movable between a first position where the shutter member connects a external circuit with a suction chamber and a second position where the shutter member disconnects the external circuit with the suction chamber in response to the inclination of the cam plate. The cam plate moves the shutter member to the second position when the cam plate is at the minimum inclined angle position to minimize the displacement of the compressor. A valve plate is located between the cylinder bore and a gas chamber. The gas chamber is either the suction chamber or the discharge chamber. The valve plate has a port that connects the cylinder bore with the gas chamber and a valve that has open and shut positions. A passage is defined between the valve plate and the valve when the valve is shut to connect the cylinder bore with the gas chamber.

28 Claims, 8 Drawing Sheets

SWASH-PLATE COMPRESSOR WITH LEAKAGE PASSAGES THROUGH THE DISCHARGE VALVES OF THE CYLINDERS

BACKGROUND OF THE INVENTION

1. Field of the Invention

The present invention relates to a variable displacement compressor that changes its discharge displacement by adjusting the inclination of a swash plate. More particularly, the present invention relates to a variable displacement compressor that stops drawing in refrigerant gas from an external refrigerant circuit and circulates the residual gas therein when the inclination of its swash plate is minimum.

2. Description of the Related Art

Vehicles typically have compressors employed in air conditioning systems. A compressor having a controllable displacement is desirable for accurately controlling the interior air temperature to make the ride comfortable for the vehicle's passengers. There is a type of compressor that is provided with a swash plate, which is tiltably supported on a rotary shaft, cylinder bores, and reciprocal pistons, which are accommodated in the bores. The inclination of the swash plate is controlled based on the difference between the pressure in a crank chamber and the pressure in the cylinder bores. The stroke of each piston is varied by the inclination of the swash plate.

Such a compressor does not employ an electromagnetic clutch to selectively connect or disconnect the shaft of the compressor with an external drive source to transmit drive force. The external drive source is directly connected to the rotary shaft. This structure eliminates shocks that would otherwise be produced by the ON/OFF action of such a clutch. Such a compressor improves the riding comfort of the vehicle's passengers. The structure also reduces the overall weight of the refrigeration system and thus reduces the manufacturing cost.

In such a clutchless system, the compressor is operated even when cooling is not necessary. With such compressors, it is important that, when cooling is unnecessary, the discharge displacement be reduced as much as possible to prevent formation of frost in the evaporator. If cooling becomes unnecessary or if frost starts forming, the circulation of the refrigerant gas between the compressor and the external refrigerant circuit should be stopped. As shown in FIG. 12, a typical compressor has a shutter 150 that blocks the gas from an external refrigerant circuit (not shown) from flowing into a suction chamber 154. This stops the circulation of the refrigerant gas.

As shown in FIG. 12, the hollow cylindrical shutter 150 is slidably accommodated in a shutter chamber 152, which is defined in a cylinder block 151. The shutter 150 moves along the axis of a rotary shaft 156 in accordance with the inclination of a swash plate 157, which is supported by the drive shaft 156. A rear housing 158 is coupled to the rear end of the cylinder block 151 with a valve plate 159 provided in between. The rear housing 158 includes a suction chamber 154, a discharge chamber 160, and a suction passage 154. The suction chamber 153 is connected to the external refrigerant circuit. The suction passage 153 is communicated with the external refrigeration circuit via the shutter chamber 152. A positioning surface 155 is defined on the cylinder block 151 between the shutter chamber 152 and the suction passage 153.

A plurality of cylinder bores 163 extend through the cylinder block 151. A piston 161 is coupled to the swash plate 157 by a pair of shoes 162 and one piston 161 is accommodated in each bore 163. The swash plate 157 rotates integrally with the rotary shaft 156. The rotating movement of the swash plate 157 is converted to linear reciprocating movement of each piston 161 in the associated cylinder bore 163. The stroke of the pistons 161 corresponds to the inclination of the swash plate 157.

When the swash plate 157 is fully inclined with respect to the axis of the shaft 156, in which state the compressor displacement becomes maximal, the shutter 150 is moved to an opening position as shown by the solid lines in FIG. 12. The shutter 150 in the opening position enables communication between the suction passage 153 and the suction chamber 154. Therefore, as the piston 161 reciprocates, the refrigerant gas is drawn into each cylinder bore 163 from the external refrigeration circuit via the suction passage 153 and the suction chamber 154. The gas is then compressed in the cylinder bore 163. The compressed gas is discharged to the external refrigeration circuit via the discharge chamber 160.

As the inclination of the swash plate 157 becomes smaller from this state, the shutter 150 moves toward the positioning surface 155. When the inclination of the swash plate becomes minimal, causing the compressor displacement to be minimal, the shutter 150 abuts against the positioning surface 155 as shown by the double-dotted lines in FIG. 12. The abutment restricts the movement of the shutter 150 toward the positioning surface 155 and positions the shutter 150 at a closed position such that the shutter 150 disconnects the suction passage 153 from the suction chamber 154. Accordingly, the refrigerant gas stops flowing into the suction chamber 154 from the external refrigeration circuit. This stops the circulation of refrigerant gas between the external refrigeration circuit and the compressor.

In the above compressor, refrigerant gas is discharged from the cylinder bores 163 into the discharge chamber 160 and then drawn into the crank chamber 164 when the refrigerant gas in the external refrigerant circuit is hindered from flowing into the suction chamber 154. The refrigerant gas in the crank chamber 164 flows into the suction chamber 154 and is then drawn into each cylinder bore 163 during the suction stroke of the piston 161. In other words, a circulation passage is formed in the compressor when the flow of the refrigerant gas from the external refrigerant gas into the suction chamber 154 is stopped. The circulation passage, through which refrigerant gas circulates, is defined between the cylinder bores 163, discharge chamber 160, crank chamber 164, the suction chamber 154 and the cylinder bores 163. Refrigerant gas includes mist-like lubricant. The lubricant circulates through the circulation passage suspended in the refrigerant gas to lubricate various parts in the compressor.

A valve plate 159 has a suction port 165 and a discharge port 166. The plate 159 also includes a flapper type suction valve 167 and a flapper type discharge valve 168 for selectively opening and closing the ports 165 and 166. The flapper type valves 167, 168 close the ports 165, 166, respectively. Therefore, in order to open the ports 165, 166, the valves 167, 168 should be flexed against their elasticity. The mist-like lubricant in the refrigerant gas liquefies and adheres to the valves 167, 168 and also on the ports 165, 166 at sections surrounding the port valves, where the valves 167, 168 come into contact with the ports 165, 166, respectively. The liquefied lubricant adheres the valves 167, 168 to the valve plate 159 and makes it difficult to open the valves 167, 168.

When its inclination becomes small, the swash plate 157 moves toward the rear end of the compressor (right in FIG.

12) along the axis of the rotary shaft 156. The movement of the swash plate 157 pushes the shutter 150 toward the positioning surface 155 and the pistons 161 toward the rear end of the compressor. Therefore, the piston 161 moves relatively close to the valve plate 159 with a short stroke when the swash plate 157 is minimally inclined. In this state, if the valves 168, 167 adhere to the valve plate 159 and liquefied lubricant resides in the cylinder bore 163, the lubricant may not be discharged from the bores 163. The liquefied oil in each bore 163 also obstructs the piston 161 from moving close to the valve plate 159. This affects the movement of the swash plate 157 and hinders it from moving to its rear end position, where the inclination angle becomes minimal. Accordingly, the shutter 150 is hindered from moving to the closed position for disconnecting the suction passage 153 and the suction chamber 154. This causes the refrigerant gas in the external refrigerant circuit to leak into the suction chamber 154.

In this case, if refrigerant gas in the external refrigerant circuit is liquefied by a decrease in ambient temperature, the liquefied refrigerant flows into the compressor via the suction passage 153. The liquefied refrigerant washes away the lubricant inside the compressor. When operation of the compressor is resumed with a large displacement, the lubricant in the compressor in the liquefied refrigerant is drawn into the external refrigerant circuit. Thus, lubrication in the compressor becomes less than desirable. The lubricant also flows into an evaporator in the external refrigerant circuit and thereby decreases the cooling efficiency.

SUMMARY OF THE INVENTION

Accordingly, it is an objective of the present invention to provide a variable displacement compressor that prevents liquefied refrigerant in an external refrigerant circuit from flowing into the compressor when the compressor's displacement is minimal.

To achieve the above objects, the compressor according to the present invention has a cam plate located in the crank chamber and mounted on the drive shaft. The cam plate is tiltable between a maximum inclined angle position and a minimum inclined angle position with respect to a plane perpendicular to an axis of the drive shaft according to the difference between the pressures in the crank chamber and a cylinder bore. The cam plate varies the stroke of the piston in the cylinder bore based on the inclination thereof to control the displacement of the compressor. A shutter member is movable between a first position where the shutter member connects the refrigerant circuit with the suction chamber and a second position where the shutter member disconnects the external circuit from the suction chamber in response to the inclination of the cam plate. The cam plate moves the shutter member to the second position when the cam plate is at the minimum inclined angle position to minimize the displacement of the compressor. A valve plate is located between the cylinder bore and a gas chamber. The gas chamber is either the suction chamber or the discharge chamber. The valve plate has a port that connects the cylinder bore with the gas chamber and a valve that has open and shut positions. A passage is defined between the valve plate and the valve when the valve is shut to connect the cylinder bore with the gas chamber.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor according to a first embodiment of the present invention will be described below with reference to FIGS. 1 through 5.

Figure 1:
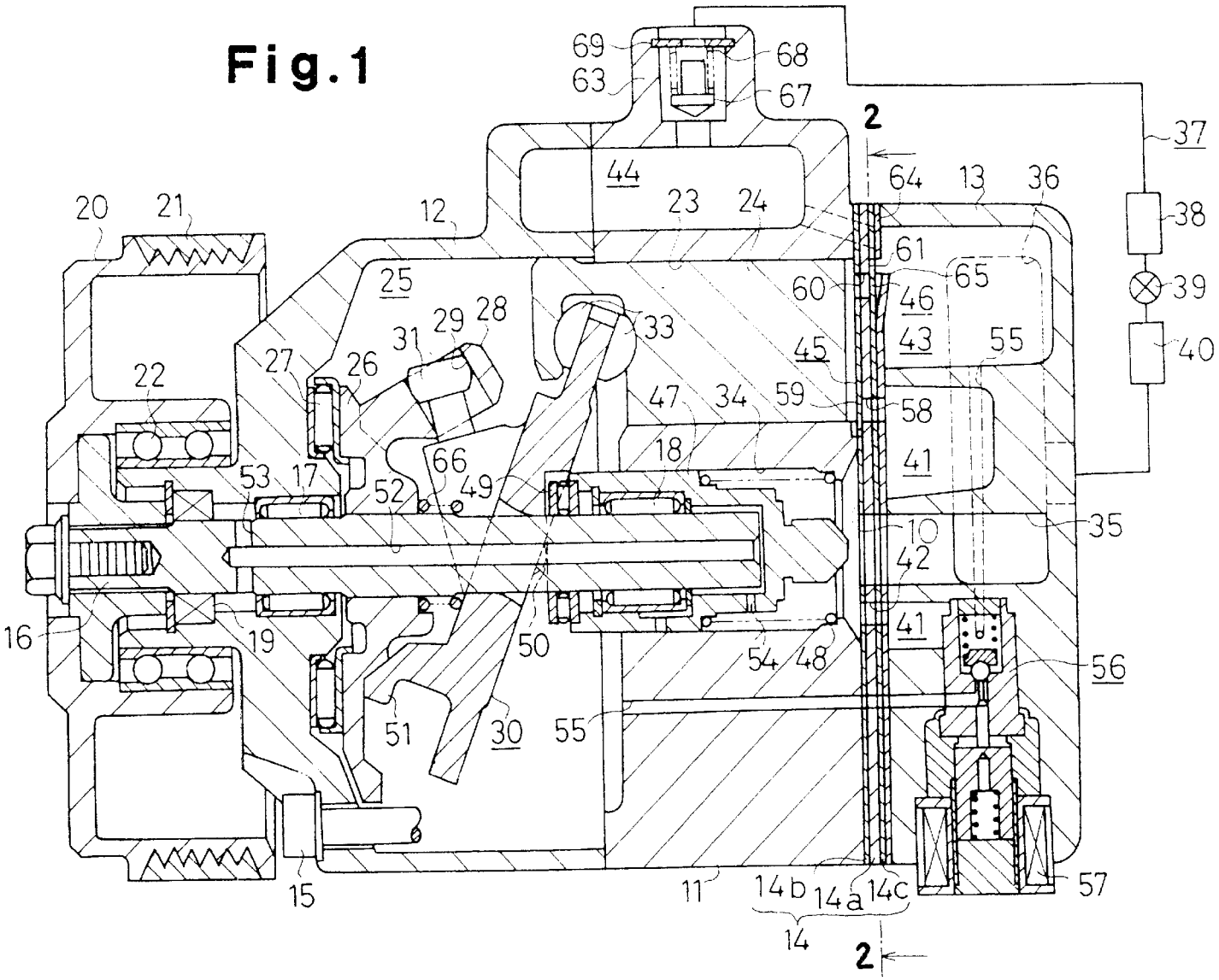
FIG. 1 is a cross-sectional view illustrating a variable displacement compressor according to first and second embodiments of the present invention.

As shown in FIG. 1, a cylinder block 11 constitutes a part of a compressor housing. A front housing 12 is secured to the front end of the cylinder block 11. A rear housing 13 is secured to the rear end of the cylinder block 11 with a valve plate 14 arranged in between. A crank chamber 25 is defined in the front housing 12. A plurality of bolts 15, which extend through the front housing 12, the cylinder block 11, and valve plate 14, are screwed into the rear housing 13. The bolts 15 fix the front housing 12 and the rear housing 13 to the front end face and the rear end face of the cylinder block 11.

A rotary shaft 16 is rotatably supported by a pair of radial bearings 17, 18 and extends through the center of the cylinder block 11 and the front housing 12. A lip seal 19 is located between the rotary shaft 16 and the front housing 12. The lip seal 19 seals the crank chamber 25. The front end of the rotary shaft 16 is secured to a pulley 20. The pulley 20 is directly coupled to a drive source such as a vehicle's engine by a belt 21. An angular bearing 22 is placed between the pulley 20 and the front housing 12. The angular bearing 22 carries thrust and radial loads.

A substantially disk-like swash plate 30 is supported by the rotary shaft 16 in such a way as to be slidable along and tiltable with respect to the axis of the shaft 16. The swash plate 30 is provided with a pair of guide pins 31, each having a spherical body at its distal end. A rotor 26 is fixed to the rotary shaft 16 in the crank chamber 25. The rotor 26 rotates integrally with the rotary shaft 16. A thrust bearing 27 is arranged between the rotor 26 and the front housing 12. The rotor 26 has a support arm 28 protruding toward the swash plate 30. A pair of guide holes 29 are formed in the arm 28. Each guide pin 31 is slidably fit into the corresponding guide hole 29. The cooperation of the arm 28 and the guide pins 31 permits the swash plate 30 to rotate together with the rotary shaft 16. The cooperation also guides the tilting of the swash plate 30 and the movement of the swash plate 30 along the axis of the rotary shaft 16.

A plurality of cylinder bores 23 are formed extending through the cylinder block 11 about the rotary shaft 16. The bores 23 are arranged parallel to the rotary shaft 16 with a predetermined interval between each adjacent bore 23. A single-headed piston 24 is housed in each bore 23. A pair of semispheric shoes 33 is fit between each piston 24 and the swash plate 30. A semispheric portion and a flat portion are defined in each of shoes 33. Each semispheric portion slidably contacts each piston 24 while the flat portion slidably contacts the swash plate 30. The swash plate 30 rotates integrally with the rotary shaft 16. The rotating movement of the swash plate 30 is transmitted to each piston 24 through the shoes 33 and converted to a linear reciprocating movement of each piston 24 in the associated cylinder bore 22.

A shutter chamber 34 is defined in the center of the cylinder block 11, extending along the axis of the rotary shaft 16. A suction passage 35 is defined in the center portion of the rear housing 13 and the valve plate 14, extending along the axis of the rotary shaft 16. The suction passage 34 is communicated with the shutter chamber 35. The suction passage 35 is coupled to an external refrigerant circuit 37 via a suction muffler 36. The external refrigerant circuit 37 includes a condenser 38, an expansion valve 39, and an evaporator 40.

An annular suction chamber 41 is defined in the rear housing 13. The suction chamber 41 is communicated with the shutter chamber 34 via a communication hole 42. An annular discharge chamber 43 is defined around the suction chamber 41 in the rear housing 13. A discharge muffler 44 is provided on the top portion of the cylinder block 11. The discharge chamber 43 is connected to the external refrigerant circuit 37 via the discharge muffler 44.

Suction valve mechanisms 45 are formed on the valve plate 14. Each suction valve mechanism 45 corresponds to one of the cylinder bores 23. As each piston 24 moves from the top dead center to the bottom dead center in the associated cylinder bore 23, refrigerant gas in the suction chamber 41 is drawn into the cylinder bore 23 through the associated suction valve mechanism 45. Discharge valve mechanisms 46 are formed on the valve plate 14. Each discharge valve mechanism 46 corresponds to one of the cylinder bores 23. As each piston 24 moves from the bottom dead center to the top dead center in the associated cylinder bore 23, the refrigerant gas is compressed in the cylinder bore 23 and discharged to the discharge chamber 43 through the associated discharge mechanism 46.

A hollow cylindrical shutter 47 is accommodated in the shutter chamber 34 in such a way as to be slidable along the axis of the rotary shaft 16. A coil spring 48 is located between the shutter 47 and the inner wall of the shutter chamber 34. The coil spring 48 urges the shutter 47 toward the swash plate 30.

The rear end of the rotary shaft 16 is inserted in the shutter 47. The radial bearing 18 is located between the rear end of the rotary shaft 16 and the inner wall of the shutter 47. The radial bearing 18 receives radial loads applied to the rotary shaft 16. The radial bearing 18 is fixed to the inner wall of the shutter 47. Therefore, the radial bearing 18 moves with the shutter 47 along the axis of the rotary shaft 16.

A thrust bearing 49 is located between the shutter 47 and the swash plate 30 in such a way as to be slidable along the axis of the rotary shaft 16. A pair of convex protrusions 50 are formed on the rear end surface of the swash plate 30. Each protrusion 50 contacts the front race of the thrust bearing 49. The thrust bearing 49 receives loads in the axial direction between the shutter 47 and the swash plate 30.

A positioning surface 10 is formed on the valve plate 14 between the suction chamber 34 and the suction passage 35. The abutment of the rear end face of the shutter 47 and the positioning surface 10 restricts the backward movement (toward the right, as viewed in FIG. 1) of the shutter 47 and disconnects the communication of the suction passage 35 and the shutter chamber 34.

Figure 5:
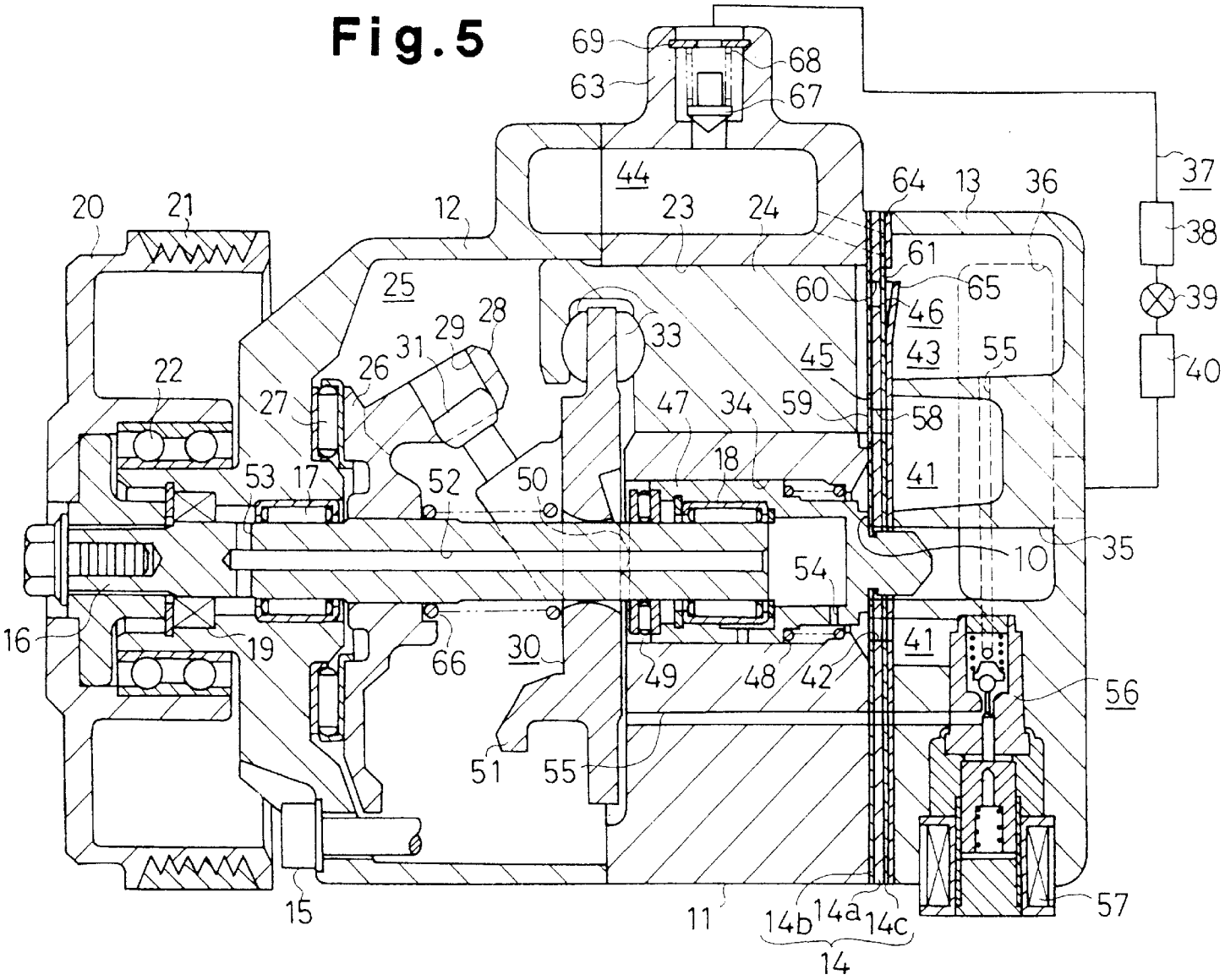
FIG. 5 is a cross-sectional view illustrating the compressor in FIG. 1 operating with minimal displacement.

As the swash plate 30 slides backward, its inclination becomes small. As the swash plate 30 slides backward, it pushes the shutter 47 with the thrust bearing 49. This moves the shutter 47 against the tension of the coil spring 48 toward the positioning surface 10. When the swash plate 30 reaches the minimum inclination as shown in FIG. 5, the rear end face of the shutter 47 contacts the positioning surface 10 and becomes located at a closed position. At the closed position, the shutter 47 disconnects the suction passage 35 from the shutter chamber 34. This prevents the swash plate 30 from further inclining from the minimum inclination and stops the flow of refrigerant gas from the external refrigerant circuit 37 to the suction chamber 41. This causes the displacement of the compressor to become minimum. The minimum inclination of the swash plate 30 is slightly larger than zero degrees. Zero degrees refers to the angle of the swash plate's inclination when it is perpendicular to the axis of the rotary shaft 16.

As the swash plate 30 moves from the minimum inclination position in FIG. 5 toward the maximum inclination, the shutter 47 is separated from the positioning surface 10 by the coil spring 48. The shutter 47 comes to an opening position shown in FIG. 1 to communicate the suction chamber 35 with the shutter chamber 34. This draws the refrigerant gas into the suction chamber 41 from the external refrigerant circuit 37 via the suction passage 35. Accordingly, the displacement of the compressor becomes maximal. The abutment of a projection 51 projecting from the front end face of the swash plate 30 against the rotor 26 prevents the inclination of the swash plate 30 beyond the predetermined maximum inclination.

A coil spring 66 is place between the rotor 26 and the swash plate 30. The coil spring 66 urges the swash plate 30 backward (in other words, in a direction that decreases the inclination of the swash plate 30).

A passage 52 is defined in the central portion of the rotary shaft 16. The passage 52 has an inlet 53 connected with the crank chamber 25 and outlet connected with the interior of the shutter 47. A pressure release hole 54 is formed in the peripheral wall of the shutter 47 near its rear end. The hole 54 communicates the interior of the shutter 47 with the shutter chamber 34. Refrigerant gas in the crank chamber 25 is released into the suction chamber 41 through the passage 52, the interior of the shutter 47, the pressure release hole 54, the shutter chamber 34, and the communication hole 42.

A supply passage 55 is defined in the rear housing 13, valve plate 14, and the cylinder block 11. The supply passage 55 connects the discharge chamber 43 to the crank chamber 25. An electromagnetic valve 56 is arranged in the rear housing 13 and located midway in the supply passage 55. When the solenoid 57 of the electromagnetic valve 56 is excited, the supply passage 55 is closed. When the solenoid 57 is de-excited, the supply passage 55 is opened. Refrigerant gas in the discharge chamber 43 flows into the crank chamber 25 via the supply passage 55.

The structure of the suction valve mechanism 45 and the discharge valve mechanism 46 will be described below.

Figure 2:
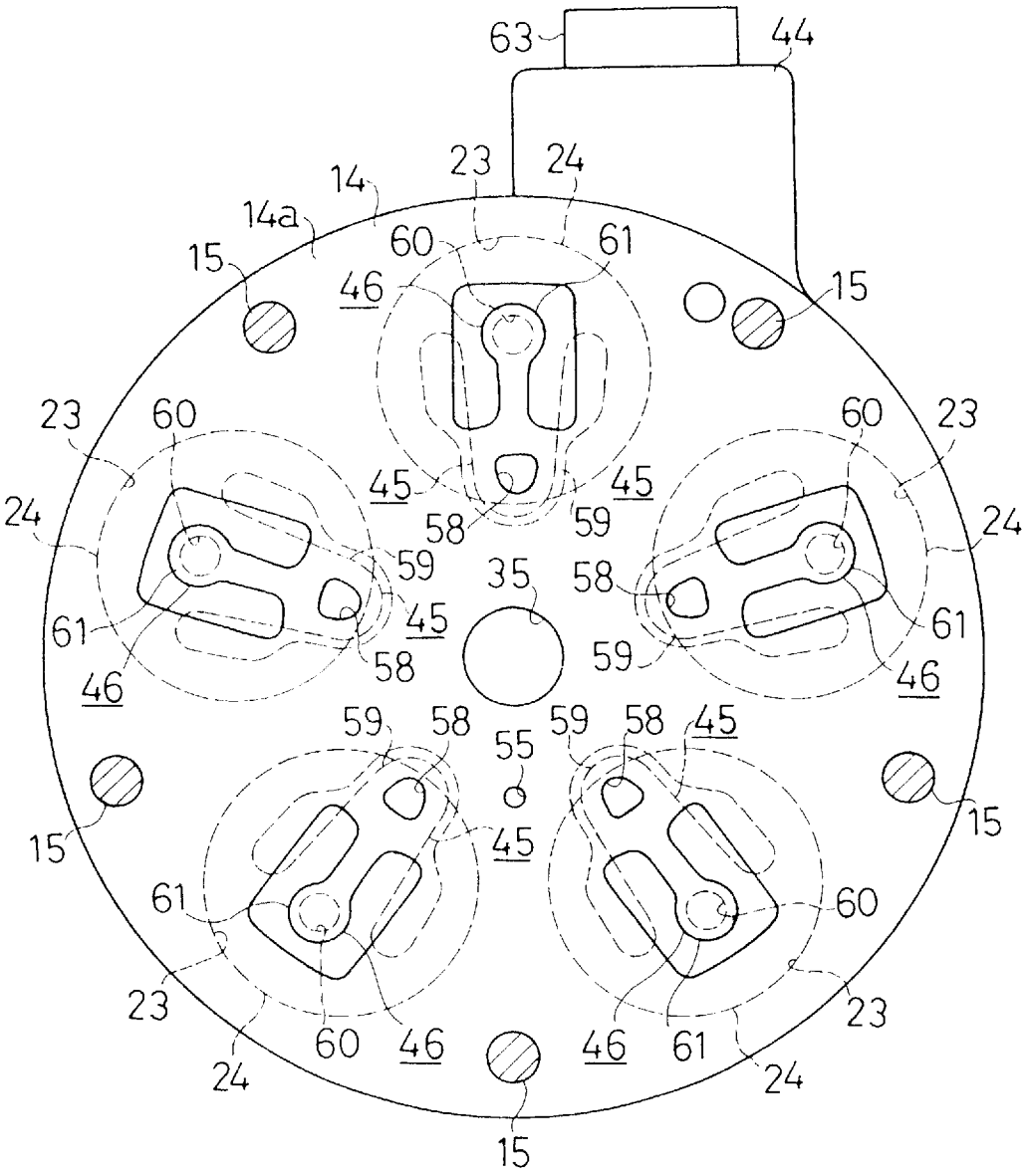
FIG. 2 is a cross-sectional view taken along line 2—2 of FIG. 1.

As shown in FIGS. 1 and 2, the valve plate 14 includes a main plate 14*a*, a first plate 14*b*, and a second plate 14*c*. The main plate 14*a* is placed between the first plate 14*b* and the second plate 14*c*. A third plate 64 is provided on the second plate 14*c*. Suction ports 58 are formed on the main plate 14*a*, second plate 14*c*, and the third plate 64. Each suction port 58 corresponds to one of the cylinder bores 23. Flapper type suction valves 59 are formed on the first plate 14*b*. Each suction valve 59 corresponds to one of the suction ports 58. Discharge ports 60 are formed on the main plate 14*a* and the first plates 14*b*. Each discharge port 60 corresponds to one of the cylinder bores 23. Flapper type discharge valves 61 are formed on the second plate 14*c*. Each discharge valve 61 corresponds to one of the discharge ports 60. Retainers 65 are formed on the third plate 64. Each retainer 65 corresponds to one of the discharge valves 61 and controls the opening of the valve 61.

Figure 3:
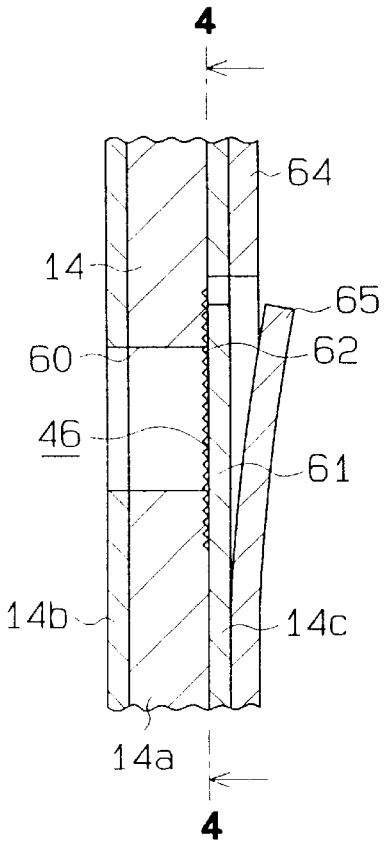
FIG. 3 is an enlarged partial cross-sectional view illustrating the valve plate of the first embodiment.
Figure 4:
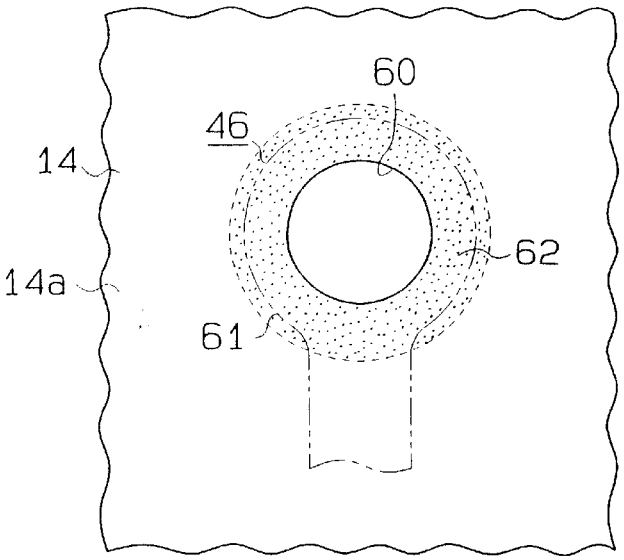
FIG. 4 is a partial cross-sectional view taken along line 4—4 of FIG. 3.

As shown in FIGS. 3 and 4, a frosted-glass-like rough surface 62 is formed around each discharge port 60 (in other words, the area that each discharge valve 61 contacts) on the main plate 14*a*. The rough surface 62 is formed, for example, through shot blasting. The rough surface 62 defines a slight space connecting the cylinder bores 23 with the outside of the associated bore 62. The rough surface 62 prevents the discharge valve 61 from adhering to the main plate 14*a*.

The surface roughness of the main plate 14*a* is 4 $\mu$mRz or less. The surface roughness of the rough surface 62 on the main plate 14*a* is preferably between 5 $\mu$mRz and 35 $\mu$mRz. More preferably, the surface roughness of the rough surface 62 is between 10 $\mu$mRz and 20 $\mu$mRz.

The rough surface 62 defines a slight space between the main plate 14*a* and each closed discharge valve 61. The space allows the lubricant and refrigerant gas in each cylinder bore 23 to be discharged into the discharge chamber 43. This enables the shutter 47 to be securely moved to the closed position where the shutter 47 disconnects the suction passage 35 from the suction chamber 41. Accordingly, the lower limit for the surface roughness of the rough surface 62 corresponds to a minimum value that initiates the discharge of the lubricant and refrigerant gas in each cylinder bore 23 to the discharge chamber 43 through the space between the main plate 14*a* and each discharge valve 61. The space between the main plate 14*a* and each closed discharge valve 61 causes the refrigerant gas in the associated cylinder bore 23 to leak into the discharge chamber 43. The space may also reverse the flow of refrigerant gas from the cylinder bores 23 to the discharge chamber 43. Therefore, the space may degrade the compression capability of the compressor. Accordingly, the upper limit for the surface roughness of the rough surface 62 corresponds to a maximum value that enables the compressor to satisfy the required compression capability.

As shown in FIGS. 1, 2 and 5, a check valve 63 is placed between the discharge muffler 44 and the external refrigerant circuit 37. The check valve 63 includes a valve body 67, a spring 68 and a spring seat 69. The check valve 63 allows compressed refrigerant gas to be discharged from the discharge muffler 44 to the external refrigerant circuit 37, while stopping any reverse flow of liquefied refrigerant from the external refrigerant circuit 37 into the muffler 44.

The operation of the above compressor will now be described.

FIG. 1 shows the solenoid 57 in the electromagnetic valve 56 in an excited state. In this state, the supply passage 55 is closed. Therefore, highly pressurized refrigerant gas in the discharge chamber 43 is not supplied to the crank chamber 25. Refrigerant gas in the crank chamber 25 flows into the suction chamber 41 via the passage 52 and the pressure release hole 54. This causes the pressure in the crank chamber 25 to approach the low pressure of the suction chamber 41, i.e., the suction pressure. This maximizes the inclination of the swash plate 30. The displacement of the compressor thus becomes maximum. When the displacement is maximum, the high pressure in the discharge chamber 43 moves the valve body 67 of the check valve 63, provided at the outlet of the discharge muffler 44, toward the spring seat 69 against the force of the spring 68. This opens the check valve 63 and releases the high pressure refrigerant gas into the external refrigerant circuit through the discharge muffler 44.

During operation of the compressor, fluctuation of the suction pressure caused by fluctuating cooling loads changes the difference between the pressure in the crank chamber 25 and the pressure in each cylinder bore 23, both of which act on each piston 24. The changes of the pressure difference alters the inclination of the swash plate 30. This adjusts the stroke of the pistons 24. As a result, the displacement of the compressor is adjusted to an appropriate level.

When the compressor is operated with the inclination of the swash plate 30 being maximum, the temperature of the evaporator 40 in the external refrigerant circuit 37 decreases gradually as the cooling load of the compressor becomes small. When the temperature of the evaporator 40 drops below the frost forming temperature, the solenoid 57 is de-excited to open the electromagnetic valve 56, as shown in FIG. 5. This draws the high pressure refrigerant gas in the discharge chamber 43 into the crank chamber 25 via the passage 55. Accordingly, the pressure in the crank chamber 25 becomes higher. This moves the swash plate 30 toward the minimum inclination from the maximum inclination. The displacement of the compressor becomes minimum when the swash plate 30 reaches the minimum inclination. This decreases the pressure in the discharge chamber 43. Accordingly, the valve body 67 of the check valve 63 is moved away from the spring seat 69 by the force of the spring 68. This closes the check valve 63 and disconnects the discharge muffler 44 from the external refrigerant circuit 37.

When the inclination becomes small, the swash plate 30 pushes the shutter 47 with the thrust bearing 49 toward the positioning surface 10. The abutment of the rear end face of the shutter 47 and the positioning surface 10 disconnects the suction chamber 41 from the suction passage 35. Accordingly, refrigerant gas stops flowing into the suction chamber 41 from the external refrigerant circuit 37. The circulation of refrigerant gas between the external refrigerant circuit 37 and the compressor is thus stopped.

The inclination of the swash plate 30 becomes minimal when the shutter 47 contacts the positioning surface 10. Since the minimum inclination of the plate 30 is slightly greater than zero degrees, refrigerant gas continues being discharged to the discharge chamber 43 from the cylinder bore 23 when the inclination of the swash plate is minimum. This allows the compressor to operate with its displacement being minimum. Refrigerant gas discharged to the discharge chamber 43 is drawn into the cylinder bore 23 again via the supply passage 55, the crank chamber 25, the passage 52 and the pressure release hole 54.

In other words, when the swash plate 30 is minimally inclined, refrigerant gas circulates through a closed circulating passage formed in the compressor. The closed passage includes the discharge chamber 43, the supply passage 55, the crank chamber 25, the passage 52, the pressure release hole 54, suction chamber 41, and the cylinder bore 23. The circulation lubricates each part in the compressor with lubricant suspended in the refrigerant gas.

An increase in cooling load when the compressor is operated with the inclination of the swash plate 30 being minimum gradually increases the temperature of the evaporator 40 in the external refrigerant circuit 37. When the temperature of the evaporator 40 exceeds the frost forming temperature, the solenoid 57 is excited to close the electromagnetic valve 56 as shown in FIG. 1. This stops the flow of refrigerant gas in the discharge chamber 43 into the crank chamber 25. Refrigerant gas in the crank chamber 25 flows into the suction chamber 41 via the passage 52 and the pressure release hole 54. This results in a pressure decrease in the crank chamber 25, thereby moving the swash plate 30 from the minimum inclination toward the maximum inclination.

As the inclination of the swash plate 30 becomes smaller, the shutter 47 moves slowly away from the positioning surface 10 due to the force of the coil spring 48. The movement of the shutter 47 gradually increases the volume of refrigerant gas drawn into the suction chamber 41 from the external refrigerant circuit 37 via the suction chamber 35. Accordingly, the volume of refrigerant gas drawn into the cylinder bore 23 from the suction chamber 41 increases gradually. This results in a gradual increase in the compressor's displacement. When the inclination of the swash plate 30 becomes the maximum, the displacement of the compressor becomes maximum. This increases the pressure in the discharge chamber 43, thereby opening the check valve 63 provided at the outlet of the discharge muffler 44. Accordingly, high pressure refrigerant gas starts flowing toward the external refrigerant circuit 37 from the discharge muffler 44.

The rough surface 62 is formed around each discharge port 60 (where each discharge valve 61 contacts) on the main plate 14*a*. Even when the valve 61 closes the port 60, slight space is defined between the rough surface 62 and the valve 61. Thus, the discharge valve 61 is prevented from being adhered to the main plate 14*a*. opening of the valve 61 is thus facilitated. Further, when the swash plate 30 moves toward the valve plate 14 as its inclination becomes smaller, lubricant and refrigerant gas in the cylinder bore 23 are smoothly discharged to the discharge chamber 43 through the space between the main plate 14*a* and the discharge valve 61. This allows the pistons 24 to move closer to the valve plate 14 (i.e., the position where the compressor displacement becomes minimum). This movement allows the swash plate 30 to slide to the rearmost position where its inclination becomes minimum. Accordingly, the shutter 47 is moved to the position to disconnect the suction chamber 41 from the suction passage 35. This prevents leakage of liquefied refrigerant from the external refrigerant circuit 37 to the suction chamber 41.

When the displacement of the compressor is minimum, the pressure in the discharge chamber 43 decreases. This closes the check valve 63 and disconnects the external refrigerant circuit 37 from the discharge muffler 44 and prevents leakage of liquefied refrigerant from the external refrigerant circuit 37 to the discharge muffler 44.

The above described embodiment has the following advantages:

(a) When the displacement of the compressor is minimum, liquefied refrigerant in the external refrigerant circuit 37 is prevented from leaking into the compressor. Therefore, lubricant in the compressor is not washed away by the liquefied refrigerant. When the displacement of the compressor becomes large, the lubricant in the compressor is prevented from leaking into the external refrigerant circuit 37 with the liquefied refrigerant. This ensures lubrication of the compressor. In addition, the structure prevents lubricant from entering the evaporator in the external refrigerant circuit 37, thereby ensuring high cooling efficiency.

(b) The rough surface 62 is formed through shot blasting. The rough surface 62 is limited to the area on the main plate 14*a* where each discharge valve 61 makes contact. Shot blasting is an efficient method to form a rough surface 62 on a limited area. The resistance of refrigerant gas when it flows between the main plate 14*a* and the discharge valve 61 may be controlled by changing the roughness of the rough surface 62 to a desirable level. The space defined by the rough surface 62 (in other words, a passage for discharging lubricant in the cylinder bore 23 to the discharge chamber 43) also serves as a restriction. Therefore, during the compressing stroke of each piston before the discharge valve opens, i.e., when each piston moves from the bottom dead center to the top dead center, leakage of refrigerant gas from the cylinder bore 23 to the discharge chamber 43 is minimal. During the suction stroke of each piston, i.e., when each piston moves from the top dead center to the bottom dead center, a reversed flow of high pressure refrigerant gas from the discharge chamber 43 to the cylinder bore is minimal. Therefore, lubricant in the cylinder bores 23 is securely discharged therefrom by a simple structure without degrading the compressing performance of the compressor.

(c) The check valve 63 is located between the exit of the discharge muffler 44 and the external refrigerant circuit 37. This structure prevents liquefied refrigerant from entering into the compressor from the external refrigerant circuit 37 via the discharge muffler 44 when the compressor is not operating or when operating with the displacement in a minimum state.

Second Embodiment

A second embodiment of the present invention will now be described with reference to FIGS. 1, 2, 6 and 7.

In this embodiment, the rough surface 62 is formed around each suction port 58 (where the suction valve contacts) on the main plate 14*a* through shot blasting. The rough surface 62 defines a slight space between the closed valve 59 and the main plate 14*a*. This prevents the suction valve 59 from adhering to the main plate 14*a*. Accordingly, the suction valve 59 may easily be opened.

The surface roughness of the main plate 14*a* is 4 $\mu$mRz or less. The surface roughness of the rough surface 62 on the main plate 14*a* is preferably between 5 $\mu$mRz and 35 $\mu$mRz. More preferably, the surface roughness of the rough surface 62 is between 10 $\mu$mRz and 20 $\mu$mRz.

The lower limit for the surface roughness of the rough surface 62 corresponds to a minimum value that initiates the discharge of the lubricant and refrigerant gas in each cylinder bore 23 to the suction chamber 41 through the space between the main plate 14*a* and each suction valve 59. The upper limit for the surface roughness of the rough surface 62 corresponds to a maximum value that enables the compressor to satisfy the required compression capability and also satisfy the responsiveness required for the compressor to respond readily when the displacement of the compressor is shifted from the minimum to the maximum value.

When the piston 24 moves toward the valve plate 14 as the inclination of the swash plate 30 becomes small, the pressure in the cylinder bore 23 becomes high. The pressure urges the suction valve 59 toward the main plate 14*a*. This causes the valve 59 to close the suction port 58. However, the rough surface 62 between the suction valve 59 and the main plate 14*a* defines a slight space therebetween and prevents the suction valve 59 from adhering to the main plate 14*a*. Therefore, even if the rough surface 62 is not formed around the discharge port 60, and the discharge valve 61 adheres to the main plate 14*a*, lubricant and refrigerant gas in the cylinder bore 23 slowly flow into the suction chamber 41 through the space between the main plate 14*a* and the suction valve 59. Therefore, the shutter 47 is moved to a closed position to disconnect the suction chamber 41 from the suction passage 35. This prevents leakage of liquefied refrigerant from the external refrigerant circuit 37 into the suction chamber.

The compressor according to the second embodiment has the following advantages:

(a) As described in the first embodiment, when the displacement of the compressor is minimum, the shutter 47 is moved to the closed position to disconnect the suction chamber 41 from the suction passage 35. This prevents liquefied refrigerant in the external refrigerant circuit 37 from leaking into the suction chamber 41. Accordingly, lubricant is prevented from being washed away by liquefied refrigerant and leaking into the external refrigerant circuit 37.

(b) The space defined by the rough surface 62 (in other words, a passage for draining lubricant in the cylinder bore 23 to the suction chamber 41) also serves as a restriction. During the compressing stroke of each piston, i.e., when each piston is moving from the bottom dead center to the top dead center, leakage of refrigerant gas in the cylinder bore 23 to the suction chamber 41 is minimum. Therefore, lubricant in the cylinder bore 23 is discharged therefrom by a simple structure without degrading the compressing performance of the compressor.

Figure 8:
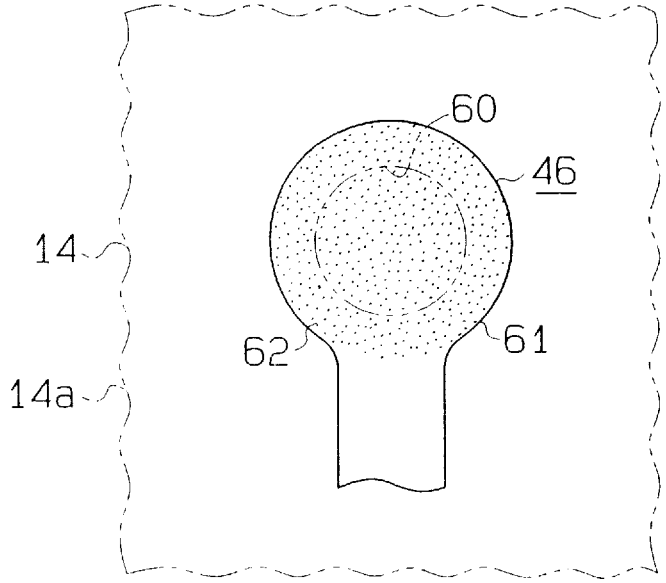
FIG. 8 is an enlarged view illustrating a discharge valve of another embodiment.

Although only two embodiments of the present invention have been described above, it should be apparent to those skilled in the art that the present invention may be embodied in many other specific forms without departing from the spirit or scope of the invention. Particularly, the invention may be embodied in the following forms:

(1) In the first embodiment, the rough surface may be formed on the side of the discharge valve 61 facing the main plate 14*a* as shown in FIG. 8.

(2) In the first embodiment shown in FIGS. 3 and 4, the rough surface 62 may be formed both on the side of the discharge valve 61 facing the main plate 14*a* and on the side of the main plate 14*a* facing the valve 61.

Figure 9:
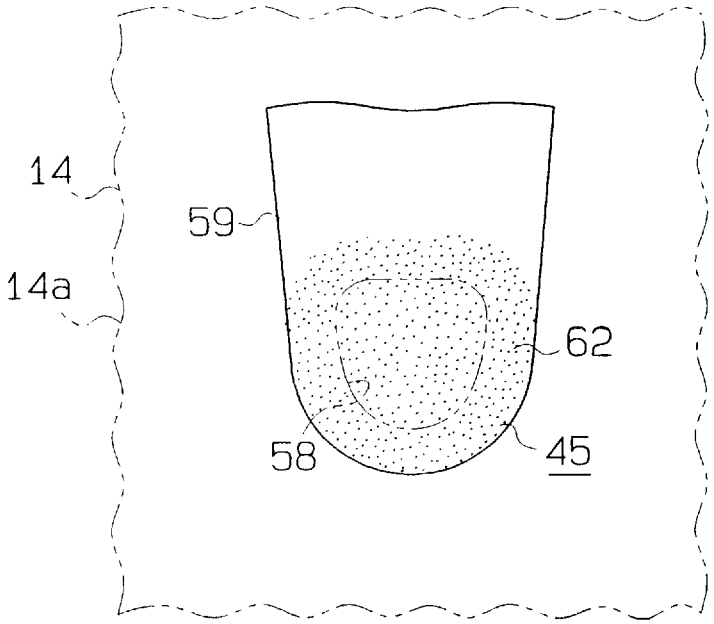
FIG. 9 is an enlarged view illustrating a suction valve of another embodiment.

(3) In the second embodiment, the rough surface may be formed on the side of the suction valve 59 facing the main plate 14*a* as shown in FIG. 9.

Figure 6:
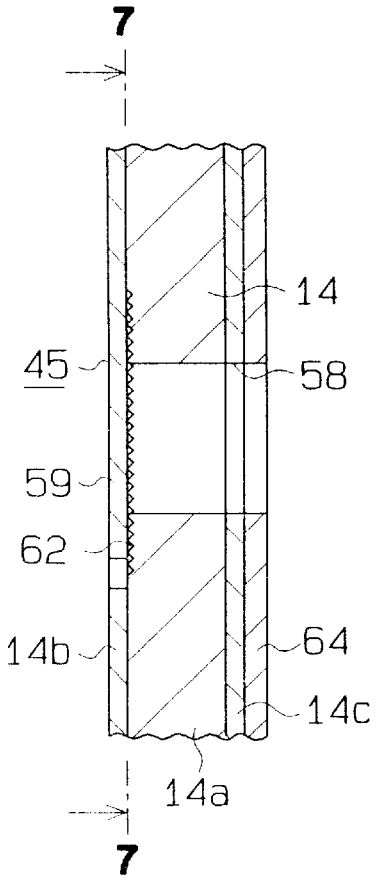
FIG. 6 is an enlarged partial cross-sectional view illustrating the valve plate of the second embodiment.
Figure 7:
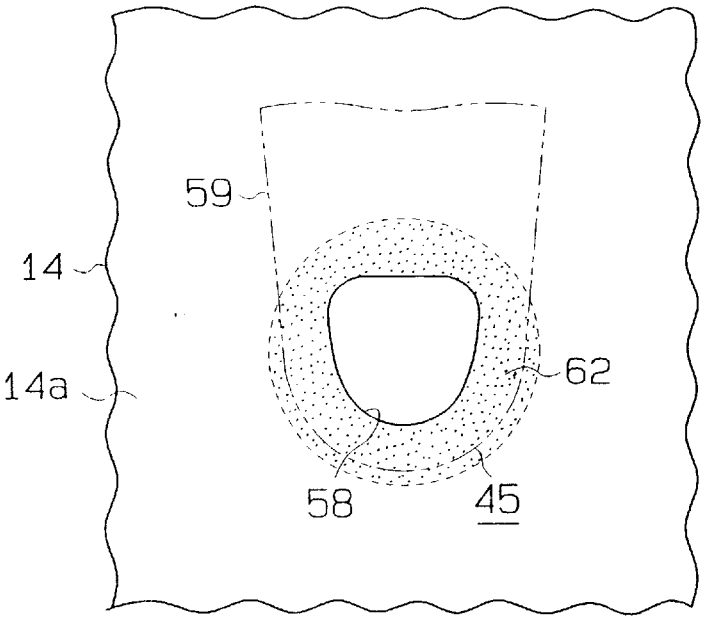
FIG. 7 is a partial cross-sectional view taken along line 7—7 of FIG. 6.

(4) In the second embodiment shown in FIGS. 6 and 7, the rough surface 62 may be formed both on the side of the suction valve 59 facing the main plate 14*a* and on the side of the main plate 14*a* facing the valve 59.

(5) The rough surface 62 may be formed on the side of the main plate 14*a* in a part facing the suction valve 59 and on the side of the main plate facing the discharge valve 61.

(6) The rough surface 62 may be formed on the side of the suction valve 59 facing the main plate 14*a* as well as on the side of the discharge valve 61 facing the main plate 14*a*.

Figure 10:
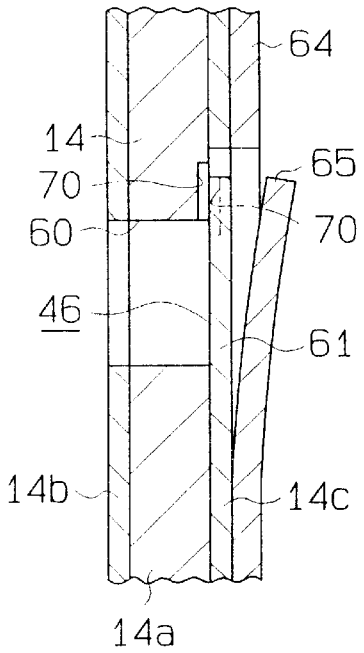
FIG. 10 is an enlarged partial cross-sectional view illustrating a valve plate according to another embodiment.
Figure 11:
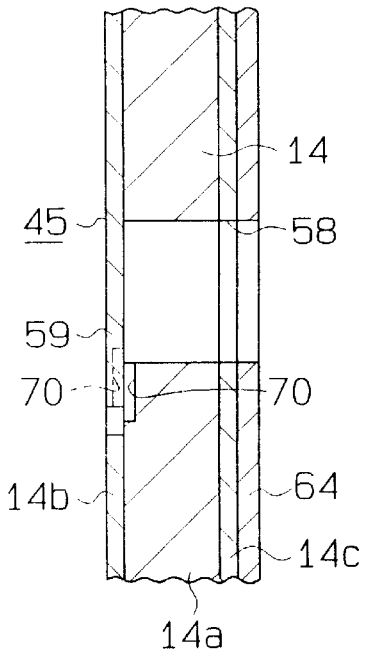
FIG. 11 is an enlarged partial cross-sectional view illustrating a valve plate according to another embodiment.
Figure 12:
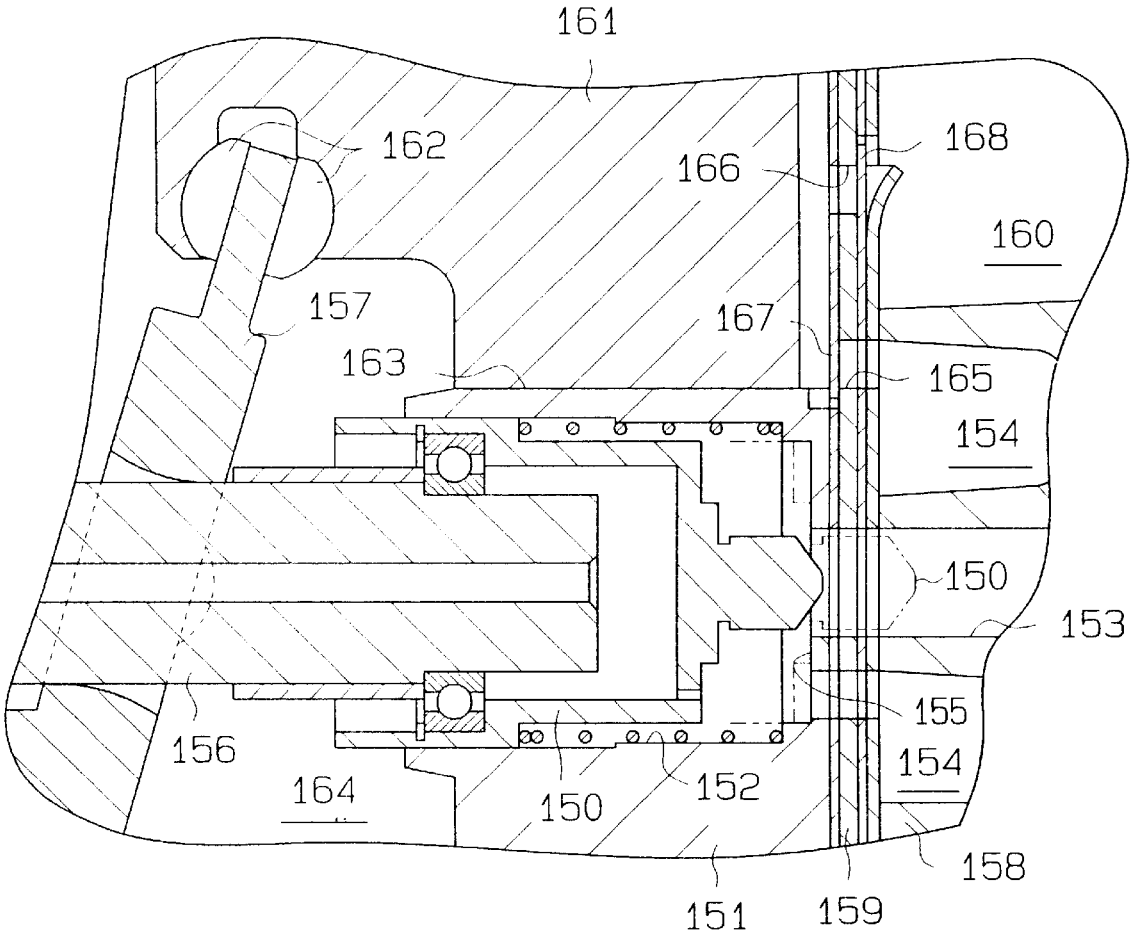
Fig.12 (Prior Art)
FIG. 12 is a partial cross-sectional view illustrating a prior art variable displacement compressor.

(7) Instead of the rough surface 62 in each embodiment, at least one groove 70 shown by solid lines and two dotted lines in FIG. 10 may be formed on either the main plate 14*a* or the discharge valve 61. The groove 70 functions as a passage for discharging lubricant from the cylinder bore 23. Similarly, at least one groove 70 shown by solid lines and two dotted lines in FIG. 11 may be formed on either the main plate 14*a* or the suction valve 59.

(8) Instead of the rough surface 62 in each embodiment, at least one notch may be formed on the main plate 14*a*, the suction valve 59, or the discharge valve 61. The notch functions as a passage for discharging lubricant from the cylinder bore 23.

(9) Instead of the rough surface 62 in each embodiment, the main plate 14*a*, the suction valve 59 or the discharge valve 61 may be provided with a knurled surface. The small space defined by the knurled surface functions as a passage for discharging lubricant from the cylinder bore 23.

(10) Instead of the rough surface 62 in each embodiment, the main plate 14*a*, the suction valve 59, or the discharge valve 61 may be provided with an embossed surface in which a passage is defined for discharging lubricant from the cylinder bore 23.

Therefore, the present examples and embodiments are to be considered as illustrative and not restrictive and the invention is not to be limited to the details giving herein, but may be modified within the scope of the appended claims.

What is claimed is:

1. A compressor having a cam plate located in a crank chamber and mounted on a drive shaft and a piston coupled to the cam plate and located in a cylinder bore, wherein said cam plate converts rotation of the drive shaft to reciprocating movement of the piston in the cylinder bore to vary a capacity of the cylinder bore, said piston compressing a refrigerant gas supplied to the cylinder bore from a separate external circuit by way of a suction chamber and discharging a compressed gas to a discharge chamber, wherein said cam plate is tiltable between a maximum inclined angle position and a minimum inclined angle position with respect to a plane perpendicular to an axis of the drive shaft according a pressure difference between the crank chamber and the cylinder bore, and wherein said cam plate varies a stroke of the piston based on an the inclination thereof to control a displacement of the compressor, said compressor comprising:

a shutter member movable between a first position wherein the shutter member connects the external circuit with the suction chamber and a second position wherein the shutter member disconnects the external circuit from the suction chamber in response to the inclination of the cam plate, whereby the cam plate moves the shutter member to the second position when the cam plate is at the minimum inclined angle position to minimize the displacement of the compressor;

a valve plate located between the cylinder bore and a gas chamber, wherein the gas chamber is one of the suction chamber and the discharge chamber, said valve plate having a port that connects the cylinder bore with the gas chamber and a valve that has open and shut positions for opening and shutting the port, respectively; and a passage defined between said valve plate and said valve when said valve is shut to connect the cylinder bore with the gas chamber, for enabling sufficient discharge of refrigerant gas and lubricant suspended therein from said cylinder bore to the gas chamber when the cam plate is at the minimum inclined angle position, for the cam plate to move the shutter member to the second position to disconnect the external circuit from the suction chamber.

2. The compressor according to claim 1, wherein said valve has a surface facing the valve plate, and wherein said valve plate has a surface facing the valve, wherein said passage is formed around the port and between said facing surface of the valve and said facing surface of the valve plate.

3. The compressor according to claim 2, wherein said port is a discharge port that connects the cylinder bore with the discharge chamber, and wherein said valve is a discharge valve that selectively opens and closes said discharge port.

4. The compressor according to claim 2, wherein said port is a suction port that connects the cylinder bore with the suction chamber, and wherein said valve is a suction valve that selectively opens and closes said suction port.

5. The compressor according to claim 2, wherein one of said valve plate surface and said valve surface is a rough surface forming said passage.

6. The compressor according to claim 5, wherein said rough surface is a shot blasted surface.

7. The compressor according to claim 5, wherein said rough surface has a surface roughness of 5–35 $\mu$mRz.

8. The compressor according to claim 2, wherein said passage is defined by at least one groove.

9. The compressor according to claim 1 further comprising a check valve placed between the external circuit and the discharge chamber to allow only the compressed gas to be discharged from the discharge chamber to the external circuit and stop the flow of liquefied refrigerant from the external circuit to the discharge chamber.

10. The compressor according to claim 9, wherein said check valve stops the compressed gas from being discharged from the discharge chamber to the external circuit when the displacement of the compressor becomes minimum.

11. The compressor according to claim 1 further comprising:

a positioning surface facing the shutter member; and said shutter member having one end surface, which abuts against the positioning surface when positioned in the second position.

12. The compressor according to claim 11, wherein said cam plate is held at the minimum inclined angle when the shutter member is positioned in the second position.

13. The compressor according to claim 11, wherein said shutter member disconnects the external circuit with the suction chamber by the end surface that abuts against the positioning surface.

14. The compressor according to claim 1 further comprising:

a release passage for connecting the crank chamber and the suction chamber to deliver the gas from the crank chamber to the suction chamber;

a supply passage for connecting the discharge chamber and the crank chamber to deliver the gas from the discharge chamber to the crank chamber; and a circulating passage including the release passage and the supply passage, said circulating passage being defined upon disconnection of the external circuit from the suction chamber.

15. The compressor according to claim 14 further comprising means for selectively opening and closing the supply passage in response to operational conditions of the compressor.

16. A compressor having a cam plate located in a crank chamber and mounted on a drive shaft and a piston coupled to the cam plate and located in a cylinder bore, wherein said cam plate converts rotation of the drive shaft to reciprocating movement of the piston in the cylinder bore to vary a capacity of the cylinder bore, said piston compressing a refrigerant gas supplied to the cylinder bore from a separate external circuit by way of a suction chamber and discharging a compressed gas to a discharge chamber, wherein said cam plate is tiltable between a maximum inclined angle position and a minimum inclined angle position with respect to a plane perpendicular to an axis of the drive shaft according to a pressure difference between the crank chamber and the cylinder bore, and wherein said cam plate varies a stroke of the piston based on an inclination thereof to control a displacement of the compressor, said compressor comprising:

a shutter member movable between a first position wherein the shutter member connects the external circuit with the suction chamber and a second position wherein the shutter member disconnects the external circuit from the suction chamber in response to the inclination of the cam plate, whereby said cam plate moves the shutter member to the second position when the cam plate is at the minimum inclined angle position to minimize the displacement of the compressor;

a release passage for connecting the crank chamber and the suction chamber to deliver the gas from the crank chamber to the suction chamber;

a supply passage for connecting the discharge chamber and the crank chamber to deliver the gas from the discharge chamber to the crank chamber;

a circulating passage including the release passage and the supply passage, said circulating passage being defined upon disconnection of the external circuit from the suction chamber;

a valve plate located between the cylinder bore and a gas chamber, wherein the gas chamber is either one of the suction chamber and the discharge chamber, said valve plate having a port that connects the cylinder bore with the gas chamber and a valve that has open and shut positions for opening and shutting the port, respectively;

a passage defined between said valve plate and said valve when said valve is shut to connect the cylinder bore with the gas chamber;

said valve having a surface facing the valve plate;

said valve plate having a surface facing the valve; and said passage being formed around the port and between said facing surface of the valve and said facing surface of the valve plate, for enabling sufficient discharge of refrigerant gas and lubricant suspended therein from said cylinder bore to the gas chamber when the cam plate is at the minimum inclined angle position, for said cam plate to move the shutter member to the second position to disconnect the external circuit from the suction chamber.

17. The compressor according to claim 16, wherein said port is a discharge port that connects the cylinder bore with the discharge chamber, and wherein said valve is a discharge valve that selectively opens and closes said discharge port.

18. The compressor according to claim 16, wherein said port is a suction port that connects the cylinder bore with the suction chamber, and wherein said valve is a suction valve that selectively opens and closes said suction port.

19. The compressor according to claim 16, wherein one of said facing surface of said valve plate and said facing surface of said valve is a rough surface forming said passage.

20. The compressor according to claim 19, wherein said rough surface is a shot blasted surface.

21. The compressor according to claim 19, wherein said rough surface has a surface roughness of 5–35 $\mu$mRz.

22. The compressor according to claim 16 further comprising a check valve placed between the external circuit and the discharge chamber to allow only the compressed gas to be discharged from the discharge chamber to the external circuit and stop the flow of liquefied refrigerant from the external circuit into the discharge chamber.

23. The compressor according to claim 22, wherein said check valve stops the compressed gas from being discharged from the discharge chamber to the external circuit when the displacement of the compressor becomes minimum.

24. The compressor according to claim 16 further comprising:

a positioning surface facing the shutter member;

said shutter member having one end surface which abuts against the positioning surface when positioned in the second position.

25. The compressor according to claim 24, wherein said cam plate is held at the minimum inclined angle when the shutter member is positioned in the second position.

26. The compressor according to claim 24, wherein said shutter member disconnects the external circuit from the suction chamber by the end surface that abuts against the positioning surface.

27. The compressor according to claim 16 further comprising means for selectively opening and closing the supply passage in response to operational conditions of the compressor.

28. A tiltable cam plate, variable displacement, piston type compressor for compressing refrigerant gas, wherein the refrigerant is mixed with oil, said compressor comprising:

a compression chamber, which forms part of a gas path that the refrigerant follows as it moves through the compressor;

a valved port for intermittently connecting the compression chamber with a part of the gas path that is outside of the compression chamber, said port having a planar area surrounding the port; and a flexible flap for intermittently contacting the planar area to close the port, wherein either one of a surface of the flap and the planar area has a groove defined therein, the groove forming a restricted passage between the flap and the planar area through which relatively small amounts of refrigerant and oil may pass when the flap is in contact with the planar area.

* * * * *

UNITED STATES PATENT AND TRADEMARK OFFICE

CERTIFICATE OF CORRECTION

PATENT NO. : 5,871,337

DATED : February 16, 1999

INVENTOR(S) : Tetsuhiko Fukanuma, et al.

It is certified that error appears in the above-identified patent and that said Letters Patent is hereby corrected as shown below:

Column 1, line 14, after "is" insert --at a--.
Column 1, line 30, change "with" to --to--.
Column 3, line 49, after "connects the" insert --external--.
Column 5, line 27, change "34" to –35--.
Column 5, line 28, change "35" to –34--.

In the Claims:

Claim 1, line 12, after "according" delete "a" and insert –to the--.

Signed and Sealed this

Third Day of August, 1999

*Attest:*

Q. TODD DICKINSON

*Attesting Officer*

*Acting Commissioner of Patents and Trademarks*